US009155922B2

(12) United States Patent
Samaniego

(10) Patent No.: US 9,155,922 B2
(45) Date of Patent: Oct. 13, 2015

(54) PROTECTIVE GARMENT HAVING AN IMPROVED HOOD

(71) Applicant: E I DU PONT DE NEMOURS AND COMPANY, Wilmington, DE (US)

(72) Inventor: Muriel Samaniego, Oberkochen (DE)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

(21) Appl. No.: 14/522,631

(22) Filed: Oct. 24, 2014

(65) Prior Publication Data

US 2015/0113716 A1 Apr. 30, 2015

Related U.S. Application Data

(60) Provisional application No. 61/896,788, filed on Oct. 29, 2013.

(51) Int. Cl.

| | |
|---|---|
| ***A41D 3/08*** | (2006.01) |
| ***A62B 17/04*** | (2006.01) |
| ***A62B 17/00*** | (2006.01) |
| ***A42B 1/04*** | (2006.01) |

(52) U.S. Cl.

CPC ..... *A62B 17/04* (2013.01); *A42B 1/048* (2013.01); *A62B 17/006* (2013.01); *A41D 2200/20* (2013.01)

(58) Field of Classification Search

CPC .... A41D 2200/20; A42B 1/046; A42B 1/248; B64D 10/00

USPC ..... 2/456, 457, 458, 2.14, 2.17, 69, 84, 2/202, 918

See application file for complete search history.

(56) References Cited

U.S. PATENT DOCUMENTS

| | | | | |
|---|---|---|---|---|
| 2,255,708 | A | 9/1940 | Laughton | |
| 4,214,321 | A | 7/1980 | Nuwayser | |
| 4,272,851 | A | 6/1981 | Goldstein | |
| 4,382,440 | A | 5/1983 | Kapp et al. | |
| 4,768,235 | A * | 9/1988 | Webster | 2/205 |
| 4,772,510 | A | 9/1988 | McClure | |

(Continued)

FOREIGN PATENT DOCUMENTS

| | | |
|---|---|---|
| CA | 2189378 | 5/1998 |
| FR | 2798828 | 3/2001 |
| GB | 2444224 | 6/2008 |

OTHER PUBLICATIONS

PCT International Search Report and Written opinion for International Application No. PCT/US2014/062168 Dated Mar. 25, 2015.

*Primary Examiner* — Tejash Patel

(57) ABSTRACT

This invention relates to a protective garment comprising a hood comprising an outer protective apparel fabric, the hood adapted to be worn on a user's head and including a face side provided with hood portions for covering the front side of the head and defining an opening for the face; a back side provided with hood portions for covering the back side of the head and comprising a hood crown portion and first and second side hood portions, the first and second side hood portions meeting along the centerline plane of the hood; the back side further having an first resilient strap secured to the inside of the back side of the hood, extending from the first side portion to the second side portion, the resilient strap positioned perpendicular to, and centered on, the centerline plane of the hood.

9 Claims, 8 Drawing Sheets

(56) References Cited

U.S. PATENT DOCUMENTS

| | | | | |
|---|---|---|---|---|
| 4,833,010 | A | 5/1989 | Langley | |
| 4,855,178 | A | 8/1989 | Langley | |
| 4,920,575 | A | 5/1990 | Bartasis et al. | |
| 5,035,941 | A | 7/1991 | Blackburn | |
| 5,162,148 | A | 11/1992 | Boye et al. | |
| 5,309,571 | A * | 5/1994 | Huang | 2/458 |
| 5,626,947 | A | 5/1997 | Hauer et al. | |
| 6,032,285 | A | 3/2000 | Densen | |
| 6,047,413 | A * | 4/2000 | Welchel et al. | 2/457 |
| 6,370,692 | B1 * | 4/2002 | Duyn et al. | 2/86 |
| 6,374,418 | B1 * | 4/2002 | Rindle | 2/202 |
| 6,397,395 | B1 * | 6/2002 | DeHart | 2/206 |
| 7,296,302 | B2 * | 11/2007 | DeLorenzo et al. | 2/84 |
| 8,037,547 | B2 * | 10/2011 | Duncan | 2/410 |
| 2008/0276357 | A1 | 11/2008 | Sigmon et al. | |
| 2011/0225699 | A1 | 9/2011 | Elhamsadat et al. | |

* cited by examiner

PROTECTIVE GARMENT HAVING AN IMPROVED HOOD

BACKGROUND OF INVENTION

Field of the Invention

This invention relates to a protective garment having an improved hood. While it is believed to be particularly useful in chemical protective garments, it can find use in any apparel used to cover or protect workers.

While protective apparel can come in a few different sizes to accommodate large variations in the frame size of wearers, generally it is prohibitive to have a large number of sizes to accommodate all the possible variations in the various parts of the human body. Plus, a one-size-fits-all approach is generally suitable for most body parts. However, variations in head size are particularly troublesome, since the vision of the wearer is so important and can be obstructed if the hood is too large for the head. Therefore, what is needed is a protective garment having a hood that can adjust for the size of the head of the wearer.

BRIEF SUMMARY OF THE INVENTION

This invention relates to protective garment comprising a hood comprising an outer protective apparel fabric, the hood adapted to be worn on a user's head, the hood having an inside surface and an outside surface, and including a face side, a back side, and a neck portion extending around the user's neck forming an opening for the neck; the face side provided with hood portions for covering the front side of the head and defining an opening for the face; the back side provided with hood portions for covering the back side of the head and comprising a hood crown portion and first and second side hood portions, the first and second side hood portions meeting along the centerline plane of the hood; the back side further having an first resilient strap secured to the inside of the back side of the hood, extending from the first side portion to the second side portion, the first resilient strap positioned generally perpendicular to, and centered on, the centerline plane of the hood.

In some embodiments, the protective garment further comprises a second resilient strap secured to the inside of the back side of the hood, the second resilient strap positioned on the centerline plane of the hood and extending from the crown portion to a meeting point of the first and second side portions.

In some embodiments, the protective garment further comprises a first and second resilient stabilizing straps secured to the inside of the back side of the hood, the first resilient stabilizing strap extending from the crown portion to a point on the first side portion, and the second resilient stabilizing strap extending from the crown portion to a point on the second side portion, the first and second resilient stabilizing straps positioned symmetrically on either side of the centerline plane of the hood.

DETAILED DESCRIPTION OF THE INVENTION

Figure 1B:
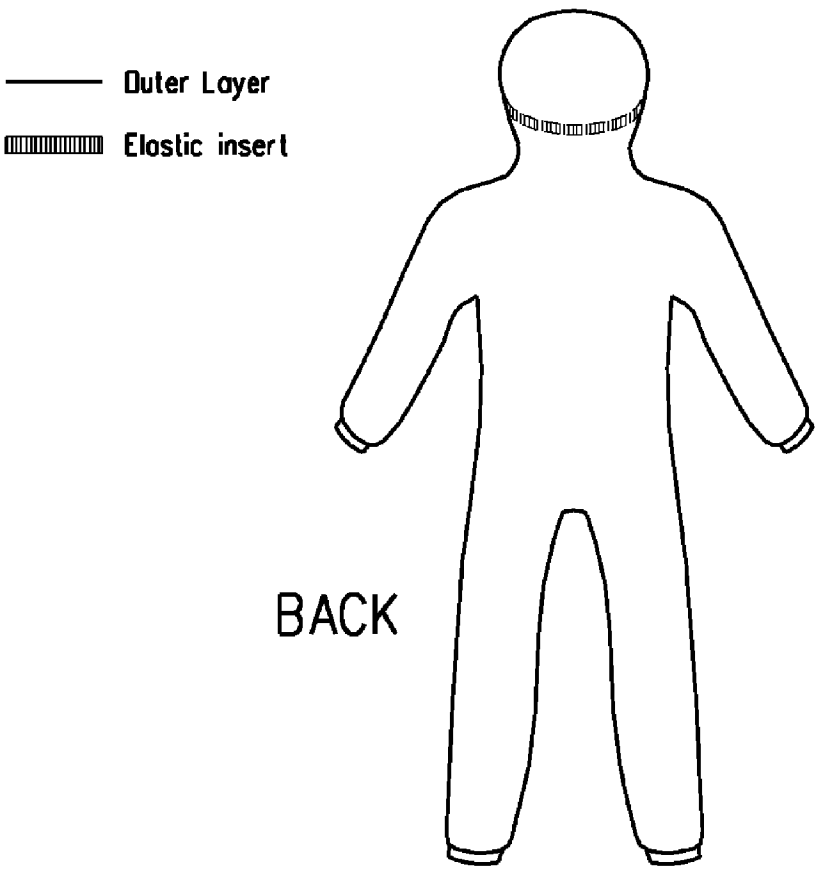
FIGS. 1A & 1B are front and back illustrations of one type of protective garment comprising a hood, shown without a lining fabric.
Figure 1A:
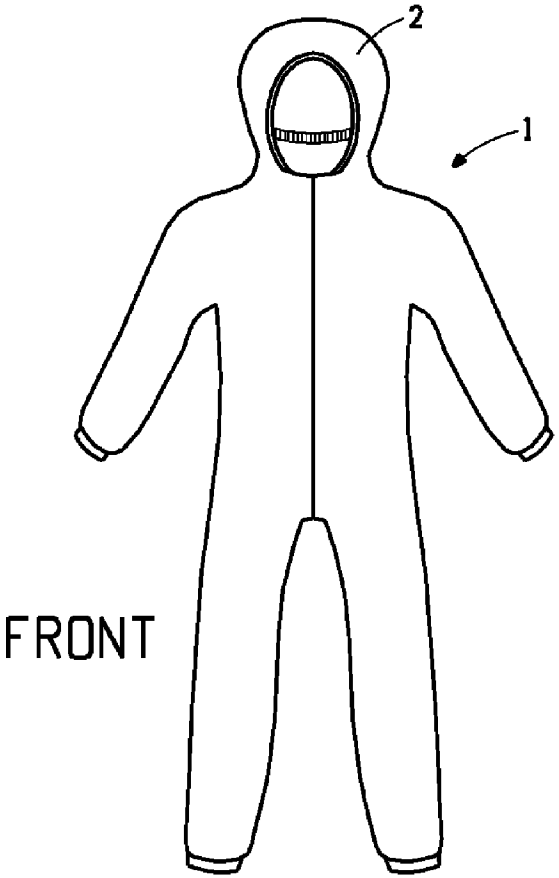

This invention relates to a protective garment having an improved hood provided with at least one resilient strap to allow the hood to better grip the head of the wearer. FIGS. 1A & 1B are front and back illustrations of a protective garment 1 comprising a hood 2, shown without a lining fabric. The hood is provided with at least one resilient strap secured to the back of the hood in a generally horizontal arrangement.

Figure 2A:
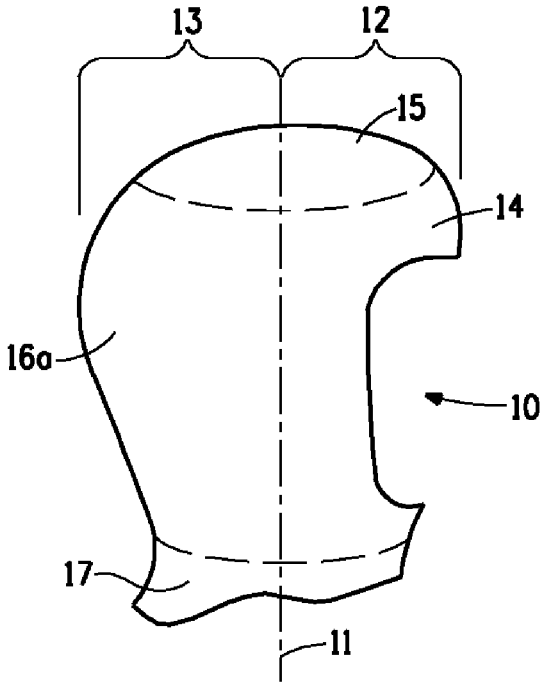
FIGS. 2A & AB are illustrations of the various parts and portions of the hood referred to herein.
Figure 2B:
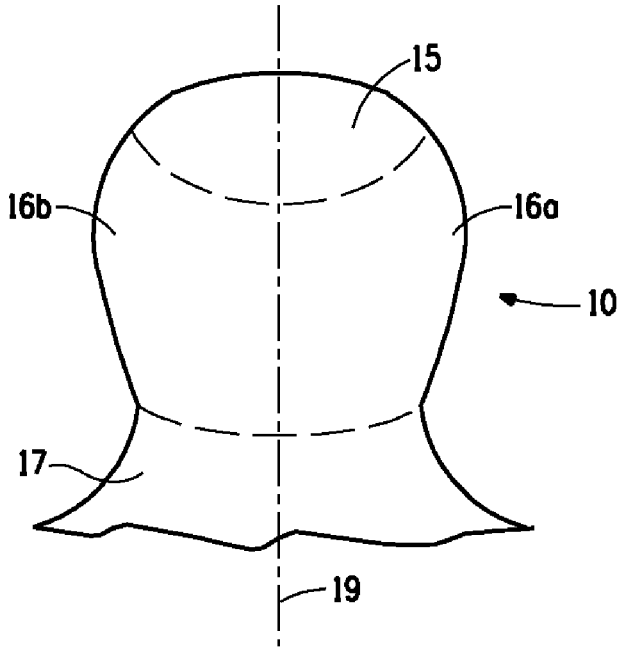

To better understand the invention, the general areas of the hood adapted to be worn on a user's head that are referred to herein are represented in FIGS. 2A & 2B, showing the side and back views of the hood. Hood 10 has an inside surface and an outside surface, the inside surface being the surface closer to the wearer and the outside surface being closer to the environment in which the wearer is working. The hood has a face side 12 and a back side 13. The two sides are defined by an imaginary vertical plane drawn through the hood and represented graphically by line 11. This vertical plane 11 is not intended to slice through the centerline of the hood but rather slice through the hood forward of the ear of the hood wearer. Vertical plane 11 is preferably positioned about halfway between the hood front and an imaginary vertical plane drawn through the center point of the hood. The hood further has a neck portion 17 extending around the user's neck forming an opening for the neck. The face side is further provided with hood portions for covering the front side of the head 14 and defining an opening for the face. The back side is further provided with hood portions for covering the back side of the head and comprising a portion of the hood crown portion 15 and first and second side hood portions 16*a* & 16*b*. The first and second side hood portions meet along the centerline plane of the hood, which is an imaginary plane running through the center point of the hood separating the hood into left and right sides, and represented graphically by line 19. The areas or portions described herein and designated in the figures generally relate to the areas of the head that are covered, and do not have to be separate pieces of fabric attached together, but can be one or more pieces of fabric cut and/or attached together as desired.

Figure 3:
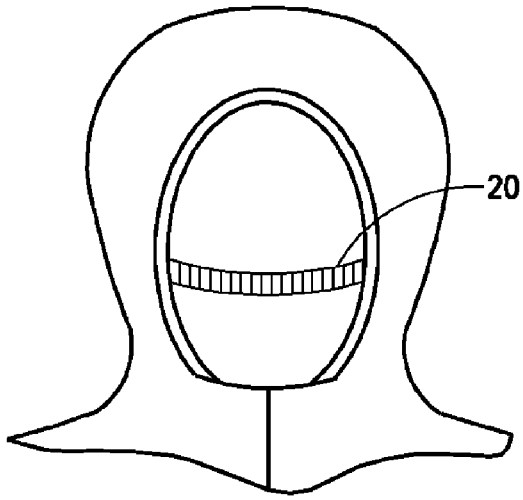
FIGS. 3 & 4 & 5 are front and side detail illustrations of a hood with a first resilient strap, shown without and with a lining fabric.
Figure 4:
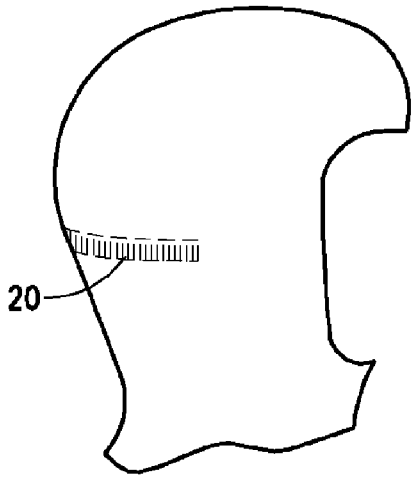
Figure 5:
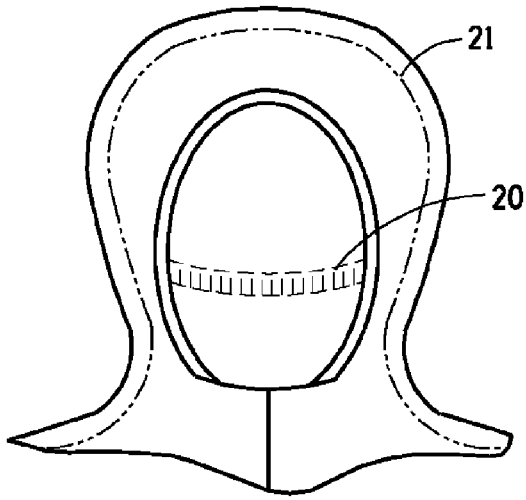

As shown in FIGS. 3, 4 & 5, showing front and side view of various versions of the hood, the back side of the hood has a first resilient strap 20 secured to the inside surface of the hood fabric. The first resilient strap extends across the back of the hood from the first side portion to the second side portion, and is positioned generally perpendicular to and centered on, the centerline plane of the hood. Preferably, the first resilient strap extends horizontally on each side portion an equal distance from the centerline plane of the hood. In some embodiments the first resilient strap, as measured in a relaxed or un-extended condition, has a total length of at least 4 inches (10 cm). In some embodiments the first resilient strap, as measured in a relaxed or un-extended condition, has a total maximum length of about 14 inches (36 cm). Further, in a preferred embodiment the first resilient strap does not extend to the front side of the hood. In some embodiments the first resilient strap, as measured in a relaxed or un-extended condition, has a total length of from approximately 6 to 12 inches (15 to 30 cm). In some embodiments, the first resilient strap has a width of approximately 6 to 15 mm (¼ to ⅝ inches). In use, this resilient strap better adapts the hood to the curved occipital bone at the back and lower part of the cranium, keeping the hood positioned correctly upright on the head.

The first resilient strap has stretch and recovery and is preferably a strap made from an elastic material. The strap is attached to the hood fabric in a matter such that the resilient strap is allowed to expand and retract to better grip the head or to bunch excess hood fabric at the back of the head. In a preferred embodiment, the first resilient strap is either sewn, glued, or heat sealed to the inside surface of the outer hood fabric while under tension.

FIG. 5 illustrates another embodiment of the hood having a first resilient strap 20 secured to the inside surface of the hood fabric along with an additional lining fabric 21 attached to the hood inside the outer protective fabric. In other words, the lining fabric is positioned between the wearer and the first resilient strap and the outer protective fabric.

Figure 6B:
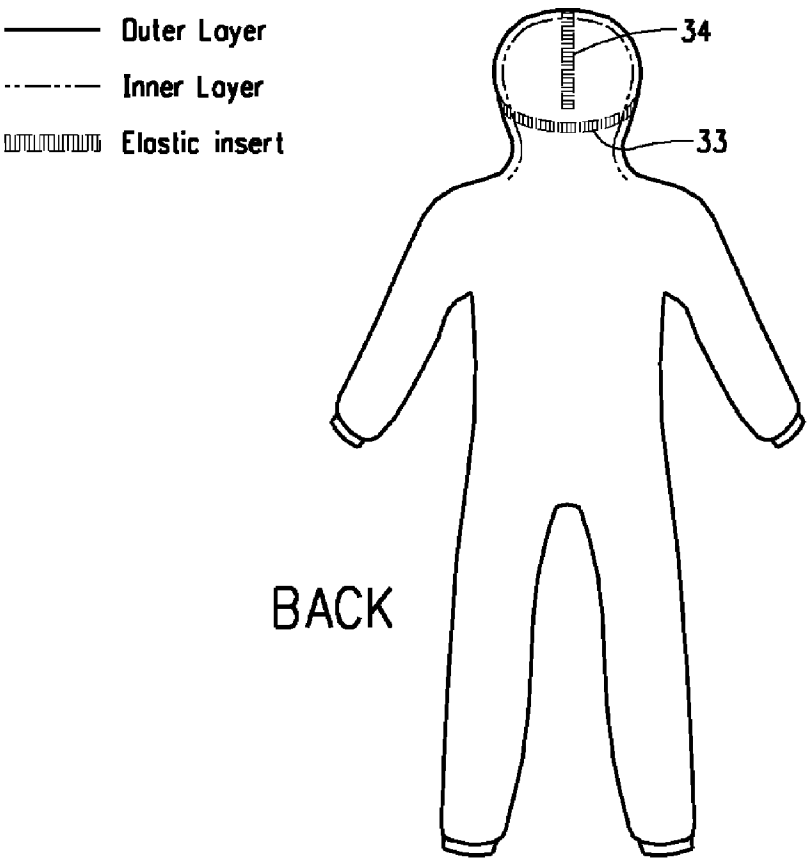
FIGS. 6A & 6B are front and back illustrations of one embodiment of a protective garment comprising a hood, shown with a lining fabric.
Figure 6A:
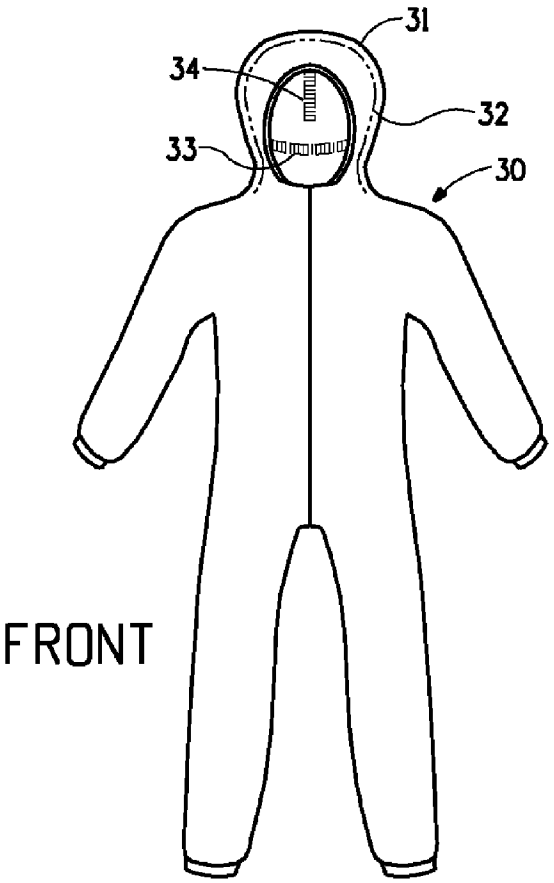
Figure 7A:
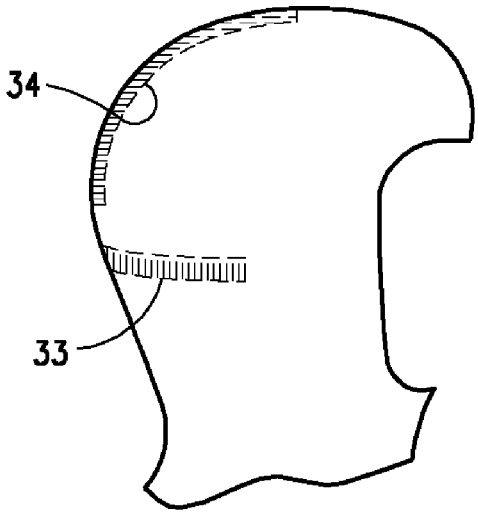
FIGS. 7A, 7B, 8A, 8B, 9A, & 9B are front and side detail illustrations of various embodiments of a hood with first and second resilient straps, shown without and with a lining fabric.
Figure 7B:
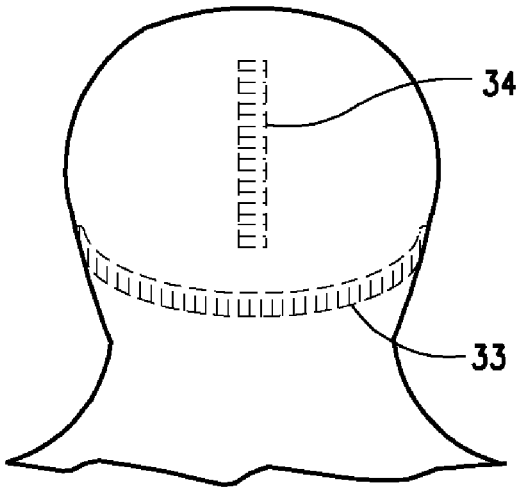

FIGS. 6A & 6B are front and back illustrations of one embodiment of a protective garment 30 comprising a hood 31, shown with a lining fabric 32 and comprising both a first resilient strap 33 and a second resilient strap 34. For clarity, the lining fabric is only shown on the hood portion, however, it is understood that the lining could continue throughout the garment as desired. Further, the first resilient strap 33 and a second resilient strap 34 are both secured to the inside surface of the outer protective fabric used for the hood.

Figure 8A:
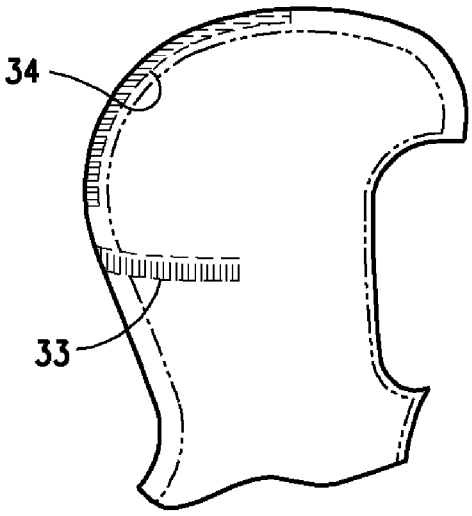
Figure 8B:
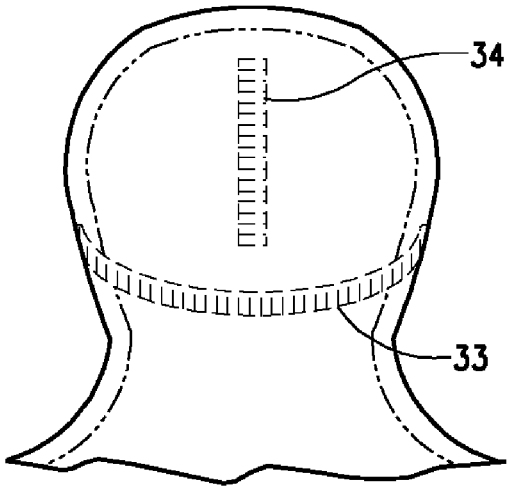

Various embodiments of the use of a second resilient strap with the first resilient strap are illustrated by the side and back views of the hoods shown in FIGS. 7A, 7B, 8A, 8B, 9A, & 9B. The second resilient strap is secured to the inside of the back of the hood and extends from the crown portion to a meeting point of the first and second side portions in the back of the hood. The second resilient strap is positioned on the centerline plane 19 of the hood. As shown in FIGS. 7A, 7B, 8A, & 8B, in one embodiment the second resilient strap 34 extends from the crown portion to a point on the centerline plane above the first resilient strap 33. FIGS. 8A & 8B further illustrate one preferred embodiment of a first resilient strap 33 and second resilient 34 strap secured to the inside surface of the hood fabric along with an additional lining fabric attached to the hood inside the outer protective fabric. In other words, the lining fabric is positioned between the wearer and the first and second resilient straps and the outer protective fabric.

Figure 9A:
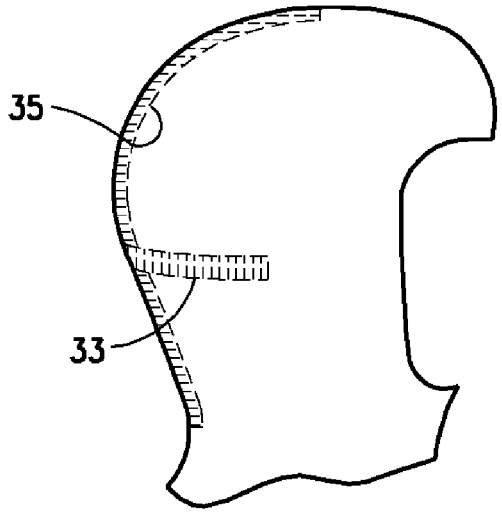

In another embodiment not shown in the figures, the second resilient strap can extend from the crown portion to the point where the first resilient strap crosses the centerline plane, and can be further joined to the first resilient strap. In another embodiment as shown in FIGS. 9A & 9B, a longer second resilient strap 35 can extend from the crown portion to a point on the centerline plane below the first resilient strap 33, and in some embodiments extending to the neck portion of the hood.

The second resilient strap has stretch and recovery and is preferably made from an elastic material. The second resilient strap is attached to the hood fabric in a matter such that the second resilient strap is allowed to expand and retract to better grip the head or to bunch excess hood fabric at the back of the head. In a preferred embodiment, the second resilient strap is either sewn, glued, or heat sealed to the inside surface of the outer hood fabric while under tension. In some embodiments, the second resilient strap and the first resilient strap are made from the same materials.

In some embodiments the second resilient strap is shorter than the first resilient strap, when measured in a relaxed or un-extended condition. In some embodiments, the second resilient strap as measured in a relaxed or un-extended condition has a length of from 4 to 8 inches (10 to 20 cm). In some other embodiments where the second resilient strap extends down the nape of the neck, it can have a total length, as measured in a relaxed or un-extended condition, of from approximately 4 to 14 inches (10 to 36 cm). In some embodiments, the second resilient strap has a width of approximately 6 to 15 mm (¼ to ⅝ inches).

Figure 9B:
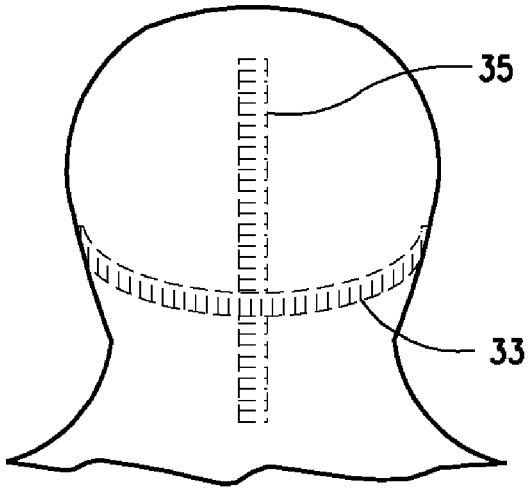
Figure 10A:
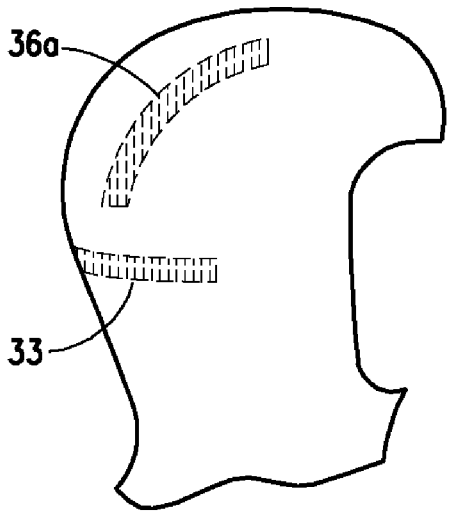
FIGS. 10A & 10B are front and side detail illustrations of one embodiment of a hood having a first resilient strap and first and second resilient stabilizing straps.
Figure 10B:
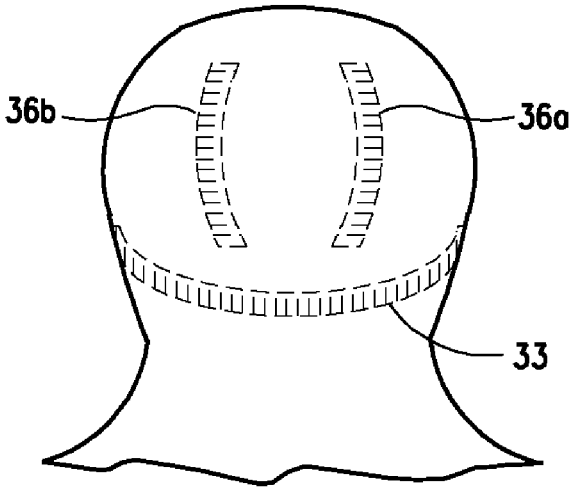

In still another embodiment, FIGS. 10A & 9B illustrate a hood for a protective garment comprising a first resilient strap 33 and first and second resilient stabilizing straps 36*a* & 36*b* secured to the inside of the back side of the hood. The first resilient stabilizing strap extends from the crown portion to a point on the first side portion, and the second resilient stabilizing strap extends from the crown portion to a point on the second side portion. The first and second resilient stabilizing straps are positioned symmetrically on either side of the centerline plane of the hood.

The first and second resilient stabilizing straps are similar to the first and/or second resilient strap in that they have stretch and recovery and are preferably made from an elastic material. The first and second resilient stabilizing straps are attached to the hood fabric in a matter such that the resilient stabilizing straps are allowed to expand and retract to better grip the head or to bunch excess hood fabric at the back of the head. In a preferred embodiment, the resilient stabilizing straps are either sewn, glued, or heat sealed to the fabric while under tension. In some embodiments, the first and second resilient stabilizing straps are made from the same materials as the first and/or second resilient strap(s).

In some preferred embodiments the first and second resilient stabilizing straps are shorter than the first resilient strap when measured in a relaxed or un-extended condition. In some embodiments, the second resilient strap has a length, as measured in a relaxed or un-extended condition, of from 2 to 8 inches (5 to 20 cm). In some embodiments, the first and second resilient stabilizing straps have a width of approximately 6 to 15 mm (¼ to ⅝ inches).

Any of the embodiments of protective garments described herein can further comprise a lining fabric. In the garment, the lining fabric is preferably attached to the hood inside any resilient straps or stabilizing straps and the protective fabric. In other words, the lining fabric is positioned between the wearer and any first and second resilient straps, any first and second stabilization straps, and the outer protective fabric. The lining can be any suitable fabric comfortable to the skin, but especially useful are woven or nonwoven fabrics. Preferably the lining is a spunlaced or spunbonded nonwoven fabric comprising fibers or filaments made from a synthetic polymer.

The garment preferably comprises a protective apparel fabric and the hood as previously described. The term "protective apparel fabric" is meant to include a wide variety of protective garment fabrics, barrier fabrics, laminates, and films. The term "protective apparel fabric" also includes nonwoven and/or woven fabrics and laminates of such materials with films or multilayer films. In some embodiments, the outer hood protective fabric comprises a chemically-resistant outer layer. In some preferred embodiments the protective apparel fabric, and therefore the apparel material, is a multilayer-film-and-nonwoven laminate. In some embodiments the apparel material is a nonwoven that resists penetration by liquids and/or particulates, such as a nonwoven like Tyvek® spunbonded polyethylene. Other useful protective apparel fabrics protect against a wide variety of threats and include but are not limited to those disclosed in U.S. Pat. No. 5,626,947 (Hauer et al.); U.S. Pat. No. 4,855,178 (Langley); U.S. Pat. No. 4,272,851 (Goldstein); U.S. Pat. No. 4,772,510 (McClure); U.S. Pat. No. 5,035,941 (Blackburn); U.S. Pat. No. 4,214,321 (Nuwayser); U.S. Pat. No. 4,920,575 (Bartasis); U.S. Pat. No. 5,162,148 (Boye); U.S. Pat. No. 4,833,010 (Langley).

In some preferred embodiments the hood is a part of a Level A, B, C or D protective garment. Level A garments are used in situations that require the highest level of skin, respiratory, and eye protection, and are generally totally encapsulating vapor protective garments. Level B garments are used in situations that require the highest level of respiratory protection but a lesser level of skin protection is needed. Level C garments are used in situations where atmospheric contaminants, liquid splashes, and other direct contact will not adversely affect or be absorbed by any exposed skin. Level D garments are used in situations where contamination is only a nuisance. There may be some instances where combinations of protective apparel rated for A, B, C, or D level may be used together. In some embodiments the hood is part of an encapsulating chemical-resistant suit, in some embodiments it is part of coveralls, or part of any type of shirt or coat or combination garment.

What is claimed is:

1. A protective garment comprising a hood comprising an outer protective apparel fabric, the hood adapted to be worn on a user's head, the hood having an inside surface and an outside surface, and including a face side, a back side, and a neck portion extending around the user's neck forming an opening for the neck;

the face side provided with hood portions for covering the front side of the head and defining an opening for the face;

the back side provided with hood portions for covering the back side of the head and comprising a hood crown portion and first and second side hood portions, the first and second side hood portions meeting along the centerline plane of the hood;

the back side further having a first resilient strap secured to the inside of the back side of the hood, extending from the first side portion to the second side portion, the first resilient strap positioned generally perpendicular to, and centered on, the centerline plane of the hood, the first resilient strap extending horizontally on each side portion no further than a vertical plane positioned halfway between the hood front and a vertical plane drawn through the center point of the hood, adapting the hood to the curved occipital bone at the back and lower part of the cranium to keep the hood positioned upright on the head.

2. A protective garment comprising a hood comprising an outer protective apparel fabric, the hood adapted to be worn on a user's head, the hood having an inside surface and an outside surface, and including a face side, a back side, and a neck portion extending around the user's neck forming an opening for the neck;

the face side provided with hood portions for covering the front side of the head and defining an opening for the face;

the back side provided with hood portions for covering the back side of the head and comprising a hood crown portion and first and second side hood portions, the first and second side hood portions meeting along the centerline plane of the hood;

the back side further having a first resilient strap secured to the inside of the back side of the hood, extending from the first side portion to the second side portion, the first resilient strap positioned generally perpendicular to, and centered on, the centerline plane of the hood;

the protective garment further comprising a second resilient strap secured to the inside of the back side of the hood, the second resilient strap positioned on the centerline plane of the hood and extending from the crown portion to a meeting point of the first and second side portions.

3. The protective garment of claim 2 wherein the second resilient strap extends to a meeting point of the first and second side portions that also includes the first resilient strap.

4. The protective garment of claim 2 wherein the second resilient strap extends to a meeting point of the first and second side portions past the first resilient strap to the neck portion of the hood.

5. A protective garment comprising a hood comprising an outer protective apparel fabric, the hood adapted to be worn on a user's head, the hood having an inside surface and an outside surface, and including a face side, a back side, and a neck portion extending around the user's neck forming an opening for the neck;

the face side provided with hood portions for covering the front side of the head and defining an opening for the face;

the back side provided with hood portions for covering the back side of the head and comprising a hood crown portion and first and second side hood portions, the first and second side hood portions meeting along the centerline plane of the hood;

the back side further having a first resilient strap secured to the inside of the back side of the hood, extending from the first side portion to the second side portion, the first resilient strap positioned generally perpendicular to, and centered on, the centerline plane of the hood;

the protective garment further comprising a first and second resilient stabilizing straps secured to the inside of the back side of the hood, the first resilient stabilizing strap extending from the crown portion to a point on the first side portion, and the second resilient stabilizing strap extending from the crown portion to a point on the second side portion, the first and second resilient stabilizing straps positioned symmetrically on either side of the centerline plane of the hood.

6. The protective garment of any one of claims 2 to 5 further comprising a lining fabric attached to the hood inside the outer protective fabric.

7. The protective garment of any one of claims 2 to 5 wherein the hood comprises a chemically-resistant outer layer.

8. The protective garment of claim 1 further comprising a lining fabric attached to the hood inside the outer protective fabric.

9. The protective garment of claim 1 wherein the hood comprises a chemically-resistant outer layer.

* * * * *